US007275967B1

(12) United States Patent
Olliff

(10) Patent No.: US 7,275,967 B1
(45) Date of Patent: Oct. 2, 2007

(54) PORTABLE POWER SUPPLY SYSTEM AND CONNECTORS THEREFOR

(76) Inventor: James W. Olliff, 1260 Linden Ave., Glendale, CA (US) 91201

( * ) Notice: Subject to any disclaimer, the term of this patent is extended or adjusted under 35 U.S.C. 154(b) by 0 days.

(21) Appl. No.: 11/303,158

(22) Filed: Dec. 15, 2005

Related U.S. Application Data

(60) Provisional application No. 60/638,505, filed on Dec. 21, 2004.

(51) Int. Cl.
*H01R 25/00* (2006.01)

(52) U.S. Cl. ..... 439/654

(58) Field of Classification Search ..... 439/677, 439/654, 652, 687, 713, 721, 286–291, 295, 439/620.3, 502; 361/833; 343/876
See application file for complete search history.

(56) References Cited

U.S. PATENT DOCUMENTS 1,950,717 A * 3/1934 Douglas ..... 439/713
2,565,075 A * 8/1951 Harcharek ..... 439/652
2,838,739 A * 6/1958 Winkler ..... 439/295
3,937,551 A * 2/1976 Persson ..... 439/717
4,148,546 A * 4/1979 Wilson et al. ..... 439/687
4,335,931 A * 6/1982 Kinnear ..... 439/295
6,132,257 A * 10/2000 Wang et al. ..... 439/620.34
6,621,724 B1 * 9/2003 Liu ..... 363/146

* cited by examiner

*Primary Examiner*—Alexander Gilman
(74) *Attorney, Agent, or Firm*—Wagner, Anderson & Bright, LLP

(57) ABSTRACT

A system and components for interconnecting low power-to-power consuming electrical systems, such as emergency communications equipment, is disclosed. The system includes polarized, genderless, and color-coded connections for cabling, power splitting to sub cables, adapt between connector families, as well as inline fusing integrated into various power connectors. The connectors include cable and connectors, multi-port connectors as well as inline-fused cables. The system and cables are virtually universally connectable in any variation of fixed or temporary power distribution layouts or control signals distribution. It may be easily assembled and disassembled for transportation and storage or change of configuration. The system also can be configured to provide adapters for between different families of connectors.

34 Claims, 12 Drawing Sheets

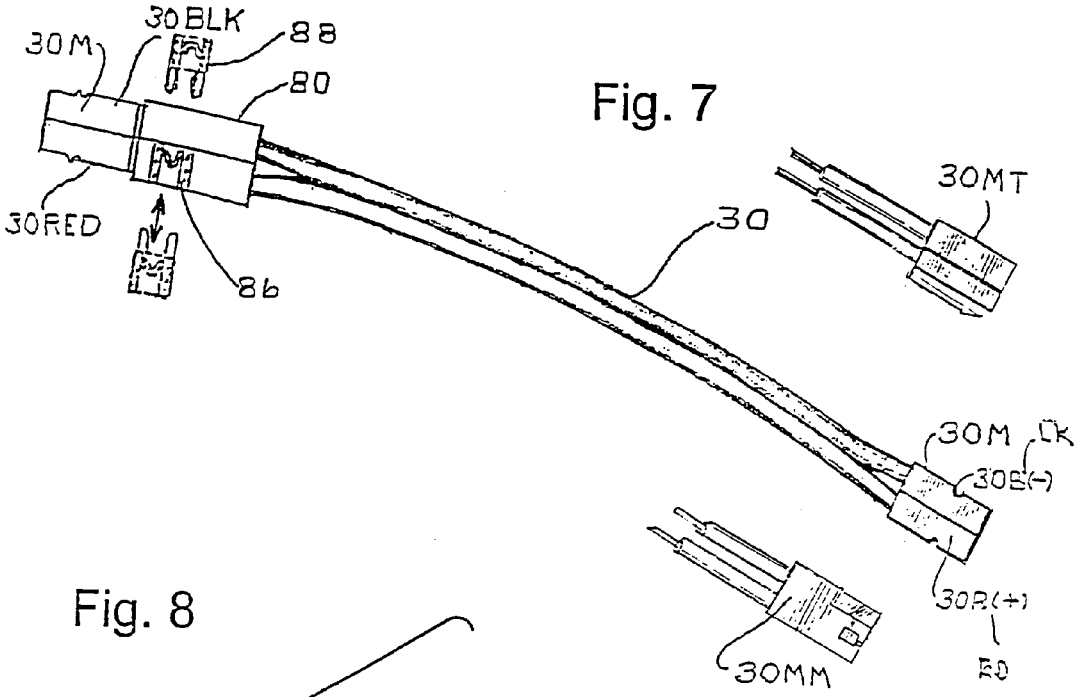
Fig. 7
Fig. 8
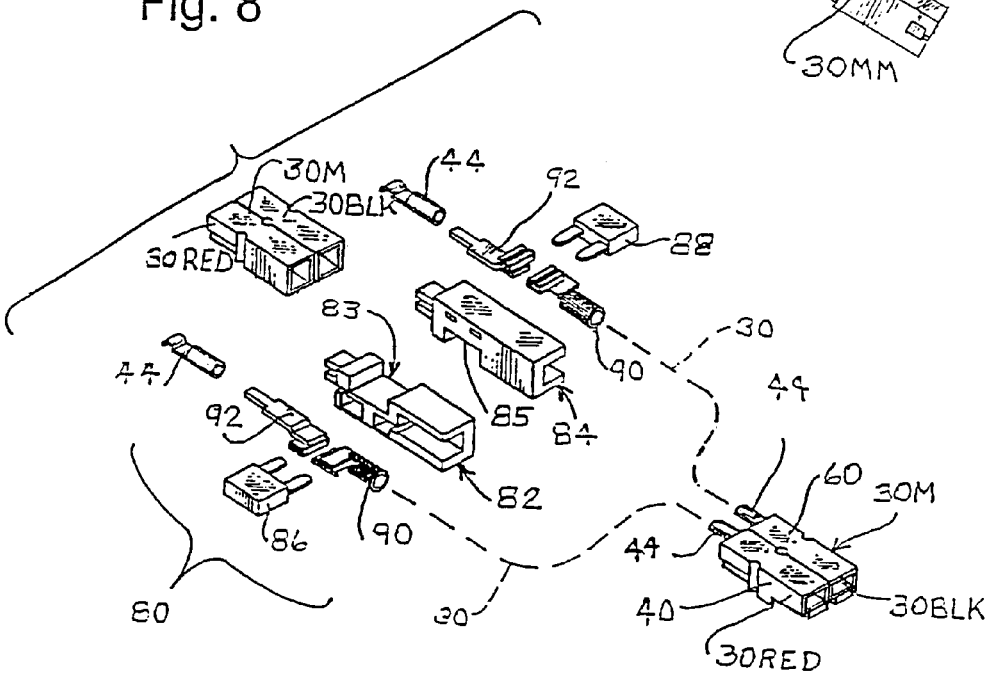

PORTABLE POWER SUPPLY SYSTEM AND CONNECTORS THEREFOR

REFERENCE TO RELATED APPLICATION

This non-provisional patent application claims benefit of U.S. provisional patent application Ser. No. 60/638,505 filed Dec. 21, 2004, and hereby claims the benefit of the embodiments therein and of the filing date thereof.

BACKGROUND OF THE INVENTION

Systems are known for distributing AC or DC voltage and current to multiple loads from one or more sources on an AC or DC power buss. The simplest form of such a system is a multiple connector box at the end of an extension power cord. A more complex system that is familiar is a connector affixed to a printed circuit board via pins extending from the connector into receiving holes in the printed circuit board. Terminal blocks with isolated positive and negative rails from which voltage is carried to appliance loads via insulated multiple conductor wire is yet another example of a system for distributing AC or DC power. In the transportation and rail service industry, common examples include those systems used by rail vehicles that carry voltage along the track rails or those using side rails or third rails as well as overhead power lines and cables common to public automotive transports with rubber tires.

Where insulated wire pairs are used, the connections are made by affixing terminals or lugs to the ends of the wires. Some terminal blocks provide studs on which the terminals can be secured using nuts and lock washers. Systems such as these have no provision for rapid disassembly or assembly. In poor light, there is no positive provision for protecting appliance loads or multiple sources from a polarity error.

In systems using terminal blocks, the task of affixing terminals to wires or terminals to the studs is time consuming and subject to defects if proper procedures such as, cleaning or clearing the contacts or studs of dirt, snow, ice, and corrosion followed by operations such as torquing nuts on studs, are not followed. If a technician is connecting a DC service from a lead acid battery or from another low impedance voltage source capable of driving multiple horsepower DC motor loads, or loads such as a heavy duty arc welder, a mistake made by the technician in connecting the polarity of the electrical service can be catastrophic.

Conventional systems for connecting one or more sources to more than one load include those that have terminal blocks with leads to service the appliance loads, Fahnestock clips and electrical connectors, barrier strips, connectors with pins that preclude polarity errors, terminal blocks with terminal connectors that preclude improper orientation, devices for selectively interconnecting a series of connectors, extension cords, multiple outlet boxes, and power strips. However, none of those systems show either separately or in combination the integrated system and components taught herein for rapidly and reliably connecting and disassembling, disconnecting and reconfiguring power to respective DC loads, and for servicing the power from one or more respective DC voltage sources. The subject system of this invention uses a common connector throughout the system with features that positively insure that proper polarity is preserved and that no exposed metal remains after a connection is made, be it a load or source connection.

BRIEF SUMMARY OF THE INVENTION

This invention relates to systems for transmitting low voltage, high current electric power to interchangeable locations with ease of connection and disconnection, and with low losses from the source or sources to the ultimate powered equipment. The system includes multiple connectors, each of which may be interchangeable and some of which can include different power connector families. This system includes a connector with an integrated fuse assembly that is part of the back of a power connector for use with the power distribution systems. Additionally, this invention may be used to interconnect multiple connectors and to connect different families of connectors of similar size and ampacity into a common bus.

In the field of power distribution, particularly in communications, which include both fixed and portable installations used for commercial, amateur radio, and military applications, there is a need to supply power to distributed power systems from a source that may be a DC power supply connected to an AC power line, a battery stack, motor generated power sources, or a source such as a solar charged battery stack. A typical station may include multiple radios, controllers, amplifiers, tuners, terminal node controllers, and computers that require power. In a typical field operation, there is a need for rapidly deploying lines and interconnecting as many stations as may be needed at varying distances from the power source, while maintaining proper polarization of the positive and negative connectors which cannot be interchanged inadvertently or otherwise.

In permanent installations, there is also a need to distribute temporary power to various permanent station equipment. In vehicles, the use of a power distribution device provides the capability to easily connect or disconnect power to individual devices. One example of the need is, when an amateur radio group has been called upon to provide emergency communication service over their own radios, as soon as possible, from remote emergency locations where the amateur radio operators are required to furnish all their own equipment, transportation, and power for communications and other necessities.

In such a situation, emergency, internal combustion engines powered AC generators supply AC power to AC to DC converters that can provide the required DC power, however, with less than the desired allowable level of transients. A better form of DC power is a bank of one or more high-capacity commercial or automotive 12-volt DC batteries or gel cells parallel connected batteries that can supply, for example 13.5 volts and up to hundreds of amp hours of ripple-free DC energy over copper lines of 12 gauge or larger wire at distances of up to several hundred feet until recharged, taken out of service, or replaced with other fully charged batteries.

This invention fills a need for low voltage power distribution of typically DC-powered equipment used in fixed installations along with applications requiring reliable, rapid transportation, deployment, connection, and change of layout. Additionally, this invention may be used to interconnect multiple connectors and different families of connectors of similar size onto a common bus.

BRIEF DESCRIPTION OF THE INVENTION

This invention is basically the combination of a low powered voltage source, cabling with polarized connectors at the ends of each cable length, along with a series of fused or unfused branch connectors that allow splitting the power from the source and to an almost unlimited number of branches and current limited only by the drain of all of the appliances which are ultimately connected to the system. The cabling and connectors are designed to be of extremely low $I^2R$ loss at the end of each branch. The system employing 12-volt batteries and or other power sources can be used with cabling up to several hundred feet total cabling length with the current passing through several junctions before reaching the appliance with minimum $I^2R$ losses.

The key to the system is the cable conductor gauge selected and of major importance, the power splitting branch connectors, and fused branch conductors.

Overload protection is supplied in the form of integrated, visible fuses that will interrupt the overloaded circuit without disturbing any upstream branches or operating systems. One preferred version of this invention is a four-port branching connector.

Any single connector of the four-port connector can serve an input port while the remaining three ports provide low loss output power branches. All of the ports are polarized and color-coded for ease of rapid correct interconnection. The connectors, such as the four-port connector, are basically flat and of such rugged design that they can be laid on the ground or floor without damage or the danger of inadvertent interruption of service from foot traffic.

Embodiments of this invention also include eight port connectors which exhibit the same characteristics of the four-port connector, particularly with respect to low loss between the input port and any of the output ports. Other versions of this invention include using one or more connector families to allow for simple conversion from one connector family to another connector family.

Characteristic of all of these multi-port connectors is the fact that the electrical contacts of all ports of a common polarity are each electrically and mechanically connected to a common unitary interconnecting member within the assembly, such as copper with distribution arms for each port.

In accordance with this invention, fuses have been integrated into the branch connector rather than the branch distribution system so as to provide the correct level of protection for each individual device, which is connected downstream from that cable. Since fuses are a resistive device and develop a voltage drop based on the current flow, keeping the minimal number of fuses in-line is desirable. Therefore, sources and loads should be individually fused based on current requirements and should be located close to the source while being located near the input end of the cable supplying a load for protection of the cable and attached equipment.

Another embodiment of this invention is a short polarized fused interconnection cable link, which can be connected at any place in the system to protect the downstream circuitry and cable from overloads. It includes condition visible snap-in fuses for each conductor with the fuses exposed at opposite sides of one end of the cable link where they are readily visible to the system operator. Restoring service after a fuse blows is achieved by observation of the condition of the fuse without disassembly, immediately removing the offending overload source from the line, replacing the blown fuse or fuses, and restoring service to the formerly overloaded circuit. All connector ports that are powered in parallel from branches upstream from a fault continue to operate and continue to remain in service.

A second way to restore service where a fuse has blown in a fuse cable assembly is to replace the fuse cable assembly with another fused cable assembly which also can be done in a matter of minutes thus eliminating the cable as well as the fuse.

One further embodiment of the invention is an in-line terminal block having an input terminal at one end, and an optional output terminal at the opposite end for in-line use, and a pair of unitary conductive common interconnecting plates that form a plurality, e.g., 8 spaced output terminals on one side, usually the top, to supply up to 8 different power needs from one location while feeding current through cabling connected to the opposite end of this terminal block. Multiple terminal blocks can be interconnected based on the application. The input connector and all output connectors for each side of the line in all embodiments are formed from one stamped or otherwise formed piece of conductive material such as 48 GA (0.065") copper. The input and output connectors on either end have been chosen to accept 6 to 12 AWG wire that have been, for example, stripped for insertion into wire clamps at opposing ends of the interconnecting plates. Other connectors, which are identical to the output terminals, i.e., polarized genderless terminals in color coded ports, may be installed based on system requirements.

All together, the conductors and cabling provide a totally flexible power distribution system, which may be easily transported, laid out connected, and ready for operation in a few minutes. The system may be modified using unused ports of the connectors without interfering with ongoing operations. Disassembly, transport, and relocation is also easily accomplished in a matter of minutes or the system may remain as a permanent one but subject to easy modification.

Throughout this application, the primary form of standard connector used is the APP polarized connector of Anderson Power Products, Inc. of Sterling, Mass. However, other families of connectors may be used as a function of the application. Some applications may require the selection of connectors having mixed styles other than the APP connectors of Anderson Power Products, Inc. Such selection of a connector style may be driven by an application such as the distribution of controls or instrumentation signals.

BRIEF DESCRIPTION OF THE DRAWINGS

This invention may be more clearly understood from the following detailed description and by reference to the drawing, in which:

FIG. 7 is a perspective view of a fused cable of this invention;

FIG. 8 is an exploded view of a fused end connector of the cable of FIG. 7;

DETAILED DESCRIPTION

Figure 1:
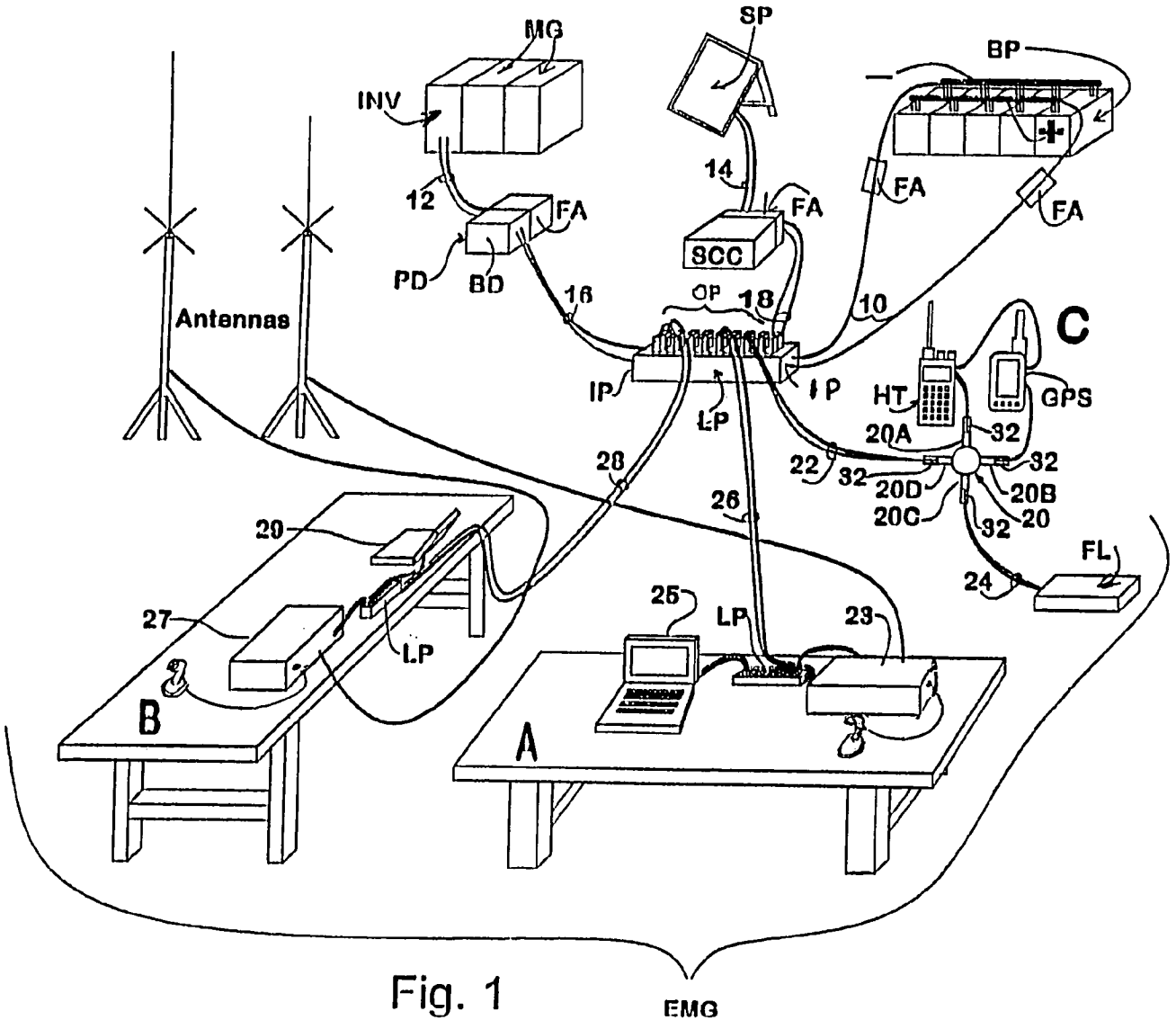
FIG. 1 is a perspective drawing of a typical emergency radio transmitter/receiver system for temporary use employing this invention.
Figure 2:
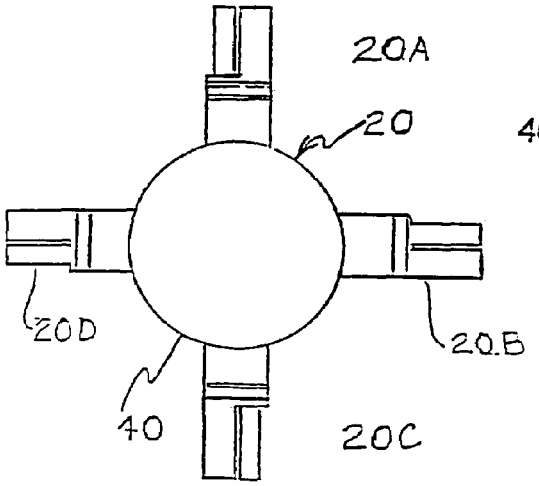
FIG. 2 is a top plan view of a four-port connector in accordance with this invention.
Figure 3:
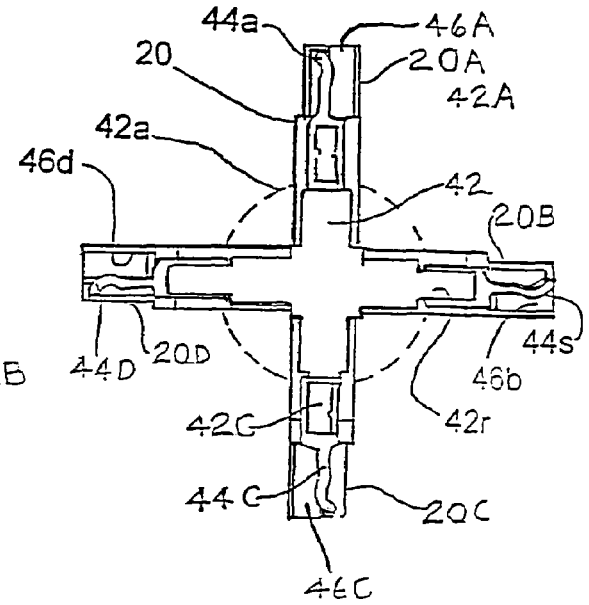
FIG. 3 is a transverse sectional of the connector of FIG. 2 taken along lines 3-3 of FIG. 4.

Referring now the drawings, FIG. 1 illustrates a typical temporary, amateur radio communication field set-up. Two equipment stations A and B are shown located on tables, each table supporting a different set of communication equipment connected to portable antenna systems to allow communication on different frequency bands simultaneously and possibly in different modes. The equipment of stations A and B may operate for voice transmissions, Morse code, packet, PSK-31, or video, as the need exists. A third station C is a equipped to provide location information for the site. A global position satellite receiver GPS and a handy-talkie HT ham radio which has an internal terminal node controller (RF modem) combine to function as an automatic position response system APRS.

All of the equipment is capable of being powered by different power sources based on availability. A battery pack BP assembled from a single to multiple parallel-connected commercial or automotive-type batteries, with their positive and negative poles connected to a primary cable, generally designated represents a first power source 10. A second alternate source is a small motor generator set MG and inverter INV designed to provide 13.5 volts DC via secondary power cable 12 to an emergency communication system, generally designated EMG. Solar cell panels SP represents a third optional power source and acts as the primary direct supply via cable 14 during daylight hours. Solar cell SP provides power to stations A, B and C via cable 14 and solar charge controller SCC.

The three above-described power sources are connected to supply DC power to the system via an in-line or branch connector LP of this invention which has an input connector IP, an output connector OP, and 6 to 8 local output ports arrayed on top of the in-line connector LP.

An inverter INV is shown connected to a protective device PD combining a blocking diode BD to prevent reverse current flow to the inverter INV and a fuse assembly FA via cable 12 and continues via cable 16 connection to an input port IP of an in-line terminal block LP of this invention.

The solar panel SP is connected to a solar charge controller SCC via cable 14 and connected to a fuse assembly FA and continues to the local output ports LP on one of the available output ports. The battery pack BP is directly connected to a fuse assembly FA then to the output connector OP of in-line terminal block LP.

Typical DC current requirements for a system of FIG. 1 are for 10 to 100 amperes at 13.5 volts. High current levels required by such distributed low-voltage DC systems mandates that such systems have the lowest $I^2R$ losses possible throughout to avoid unnecessary heating in the connectors as well as the cabling. Typical voltage drop limits for the connectors described below are less than 0.03 volts DC with 30 amperes current level for over one hour with a temperature rise of approximately 25° F.

The main power cables 10, 12, and 14 are insulated pairs of 4 to 12 gage copper conductors with a heavy-duty insulated jacket and will typically range in length up to one hundred feet depending on the particular location and the needs. Cable 22 ends with a connection plug of the basic configuration of this invention at four-port or multi-port connector 20. Multi-port connector 20 is generally flat sided and typically has four or more ports labeled 20A, 20B, 20C, and 20D. Port 20D acts as the input port in FIG. 1 with each of the other ports available as output ports. The connector 20 is better seen in FIGS. 2 through 5 to which the reader should also direct his attention.

The connector 20 has each of the ports 20A-D polarized so that power is provided to the positive + (red) jack and the negative – (black) jack. The four port or mult-port connector 20 is flat on opposing surfaces. As shown, connector 20 is sufficiently robust in its structure to permit it to be laid on the ground or the floor of a working area while it functions to provide input port 20D and three-output ports 20A-C as shown in FIG. 1. A first branch cable 26 is connected from an output port on in-line connector LP to a port on a second in-line connector LP on the table of station A.

The second in-line connector LP provides power to station A. The first branch cable 26 provides the input power to an in-line or branch connector LP, which in turn distributes power to a transceiver 23 and logging computer 25 at station A. A second branch cable 28 is connected from and output port on in-line connector LP to an input port on a third in-line connector LP on the table of station B. The second in-line connector LP provides distributes power to transceiver 27 and logging computer 29 at station B.

A third branch cable 22 provides input power to connector 20. Two local output ports LP are shown in use for apparatus at station A and B and have open ports available for use at each station for additional connections to power "Handie-Talkie™" (HTs) a Motorola trademark, Slow Scan TV (SSTV) video equipment and scanners requiring 13.5 volts DC power.

Referring again to FIG. 1, connector 20 shows a multi-port polarized connector in which the mating ports are genderless. In the case shown, all the ports are in use. Cable 22 is the DC input source at port 20D, output to HT from port 20A, output to GPS from port 20B, and output from 20C feeds cable 24 that powers a 12 volt DC fluorescent light FL. Each output cable from connector 20, ports 20A, 20B, and 20C has an integrated fuse assembly 32, that is part of the invention and which is shown and explained later in connection with FIGS. 7, 8, 9, 10 and 11. The details of connector 20 are best shown in FIGS. 2-6, while the short fused cable 30 is shown and described below in connection with FIGS. 7 and 8. The in-line multi-port connectors LP at equipment stations A, B and C are shown and described in connection with FIGS. 17-21. An eight output in-line multi-port connector LP serviced from a cable connected to OP is capable of supplying DC power to up to seven other sub-cables or pieces of equipment. Further, assembly 32, which plugs into connector 20 provides fused DC power to a handheld ratio transceiver HT.

The Four Port Connector

Figure 4:
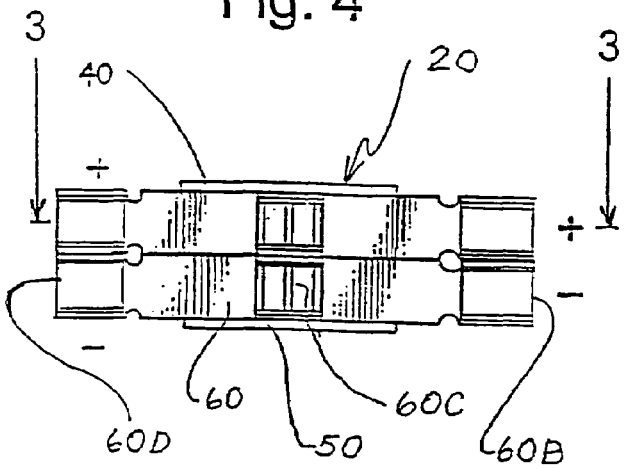
FIG. 4 is a side elevation view of the connector of FIG. 2.
Figure 5:
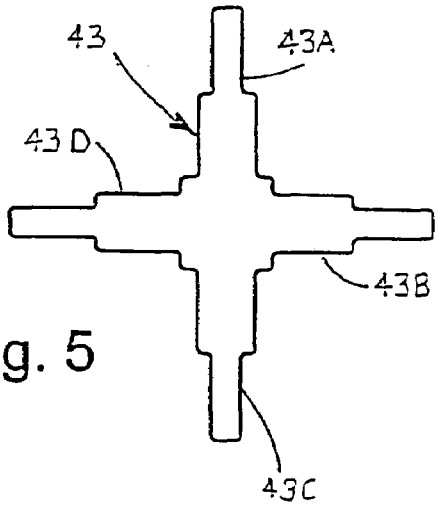
FIG. 5 is a top plan view of an inter-port connecting electrode of FIG. 3.
Figure 5A:
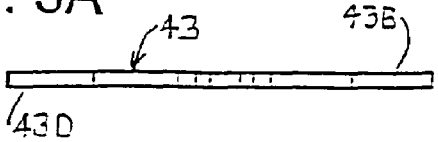
FIG. 5A is a side elevational view of the inter-port connecting electrode of FIG. 5.
Figure 6:
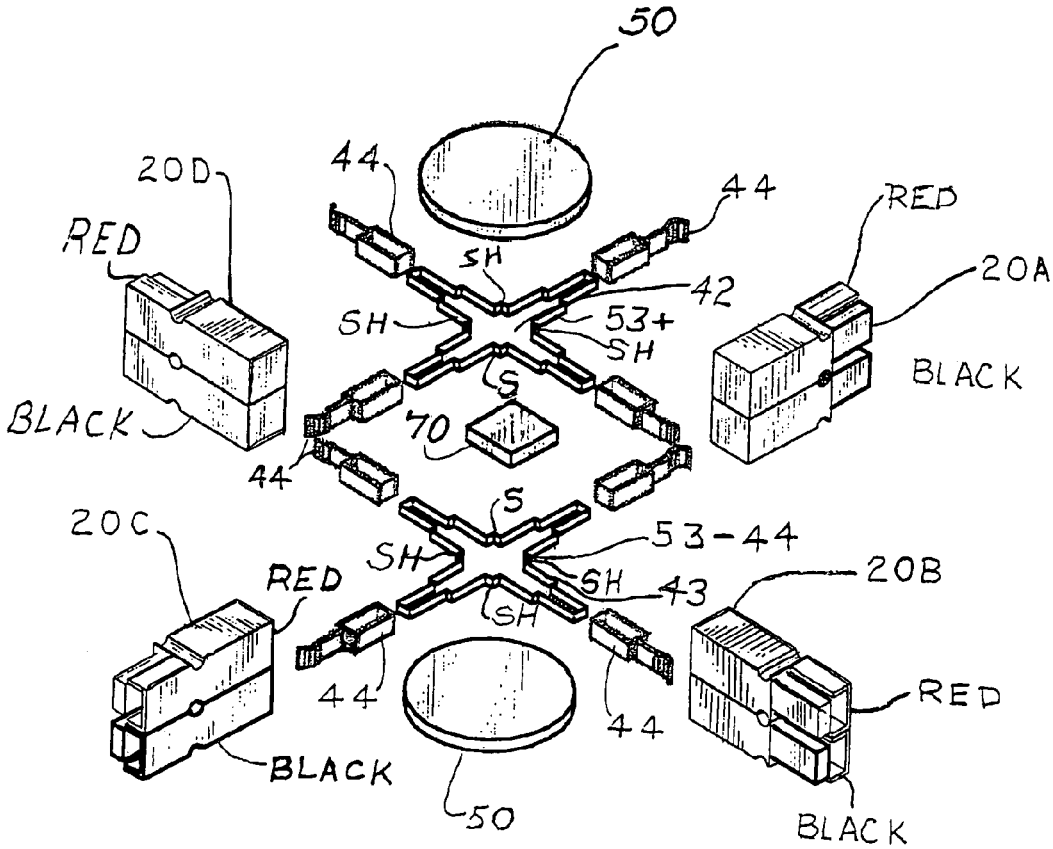
FIG. 6 is an exploded view of a four-port connector of FIG. 2 with a formed metal interconnecting electrode in accordance with this invention.

Referring now to FIGS. 2-6, connector 20 is more clearly seen with its four housings 20A-D clearly visible emerging and extending laterally outward from the central portion of the connector 20 from the central body portion cover plate 40. The central body portion cover plate 40 acts as a closure for the cruciform-shaped positive (+) interconnector 43. The cruciform-shaped positive (+) interconnector 43 is hidden in FIG. 2. However, the cruciform shaped positive (+) interconnector 43 appears in FIG. 3 in its assembled position and as a separate part in exploded views FIGS. 5 and 5A. Interconnector 43 is preferably a stamped piece of 48 oz/sq. ft. ETP 100 electronic quality copper or conductive material based on current requirements of the configuration shown in FIGS. 5 and 5A or as an alternative in the stamped and edge formed shape as illustrated in FIG. 6.

Other recognized connector materials, such as beryllium, copper or brass, with resistance between any of its four arms 43A, B, C or D of less than 0.0001 ohm might be used thereby providing a low loss interconnection between any of the ports. A spring terminal of 44A, B, C, or D is press fit onto their respective arms 43A, B, C or D of FIG. 5 and located in the positive (+) ports 46A, B, C, and D ready to receive a mating polarized positive (+) port. The housings 20A-D defining ports 46A-D are preferably configured to match standard connectors, such as APP polarized connectors of Anderson Power Products, Inc. of Sterling, Mass. 01564.

Other standard connector types, as illustrated in FIGS. 22-25, may be selected for use in accordance with this invention; however, the preferred embodiment employs contacts and polarized housings compatible with APP connectors.

In FIG. 4, it may be seen that the connector 20 includes a duplicate assembly, including a lower body portion or cover 50 that closes a second or negative conductor assembly (−) 60 with oppositely polarized ports 60A, B, C, and D, three of which may be seen in FIG. 4. All four ports are contained within the single housing and extend laterally or radially outward. A second (−) interconnection plate 43 shown in plan view, FIG. 5 and in side view FIG. 5A is identical to plate 42 and is contained within the lower portion of the housing 60 and extending into each port 60A-D. Both plates 42 and 43 may be seen in the exploded view FIG. 6, spaced apart and insulated from contact by dielectric spacer in the form of a flat plate 70 which in the assembly of FIGS. 1-4 is in contact with both conductor plates 42 and 43 within the connector assembly 20. The entire assembly 20 is a flat, substantially solid structure that can stand the abuse of repeated rapid assembly and disassembly, deployment, being laid on the ground or floor and walked upon while providing reliable power as and where needed.

FIG. 6 is a further, more complete exploded view of the cruciform four port connector 20 as seen in FIG. 5 in which all of the parts are shown, including the four double + and −, red and black housings 20A-D are present. Also, the eight spring contacts 44 positive complete the assembly 20. The inward extending ends of the housings 20A-D fully cover and engage formed plates 53+ and 53−up to their centermost shoulders SH, and the top surfaces of housings 20A-D engage and are cemented to the top disc 40 while their bottom surfaces of housings 20A-D engage and are cemented to the bottom disc 50 to form a unitary assembly. An insulating plastic plate 70 rests and is captured between the opposed portions of the plus and minus plates 53 to eliminate any possibility of shorting together.

The Fused Subcable

Referring to FIGS. 7-11, which illustrate the provision of a fused line anywhere in a low voltage power supply system in accordance with this invention.

In FIG. 7, cable 30 includes connectors port end 30M with polarized + and − red and black housings 30RED and 30BLK that are permanently secured together and polarized in shape so that only a red connector end may enter and make electrical contact with a red and vice versa for the black colored counterparts. As illustrated in FIG. 8, each housing 30RED and 30BLK contains a respective spring clip or terminal 44 capable of engaging an oppositely engaging spring 44 in a low-loss electrical spring loaded contact.

As may be seen in FIG. 7, the opposite end of the cable 30 has a second connector 30M that has the same polarization and connector springs 44 as the first connector 30M for connection to a DC load device or to a connector 20 as illustrated above or any of the other embodiments as illustrated herein. Two other alternative cable ends are shown in fragmentary cable form as 30MT and 30MM. The 30MT and 30MM fragments represent alternatives such as the common "T" shaped connector of FIG. 23, while 30MM represents a connector of the Molex 2-conducton style. Cables such as 30 are available with different type connectors at opposite ends for use as fused transition cables that may be carried and available for use and that require a different family of connectors to be matched.

Between the cable 30 and the second (upper) connector 30M, however, is a dual fuse assembly 80 as best shown in FIG. 8 in exploded form. In that figure, the housings for the two-end connectors 30M are shown exploded from the dual fuse assembly 80. Two mirror image insulated fuse holders 82 and 84 include side recesses 83 and 85, respectively, for receiving standard automotive accessory fuses 86 and 88, and two end recesses each for receiving spring connectors 92, each with their respective spring clips 44. Connectors 90 include a crimpable sleeve at their outer end to allow the cable 30 conductors to be crimped or crimped and soldered in place and a side female spring clip for receiving one terminal of their respective fuse 86 or 88. The connectors 92 have flat end terminals for engaging spring terminals 44 and side female terminals for receiving the second terminal of fuse 86 and 88.

When assembled with terminals and fuses in place, and the spring terminals 44 in their respective housings 40 and 60, an in-line fused cable is produced and ready for powering equipment while protecting it by two fuses, either of which can blow at the designated current level thereby opening the power circuit and protecting everything downstream from over-current damage. The fuses 86 and 88 have visible fusible links FL, one of which is visible in FIGS. 7, 9 and 10 and easily detected and changed in a matter of seconds.

Figure 9:
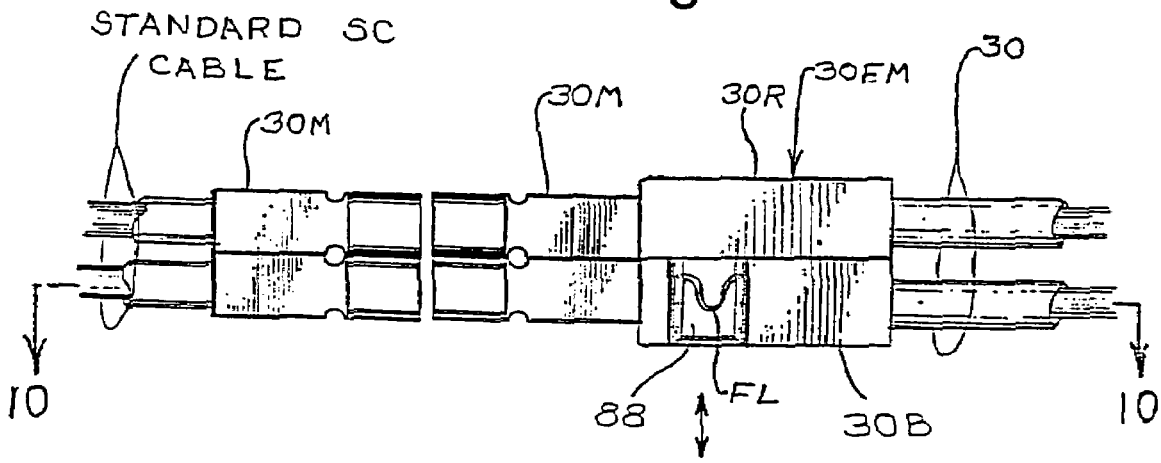
FIG. 9 is a top plan fragmentary view of a standard cable assembly and a cable assembly with integrated fused connector assembly.

FIG. 9 shows an in-line connection of a fused cable 30 with its end connector 30FM and fuse 88 in the negative (−) end connector housing 30B next to a mating end connector 30M of a standard (non-fused) cable such as cables 22, 26 and 28 of FIG. 1.

Figure 10:
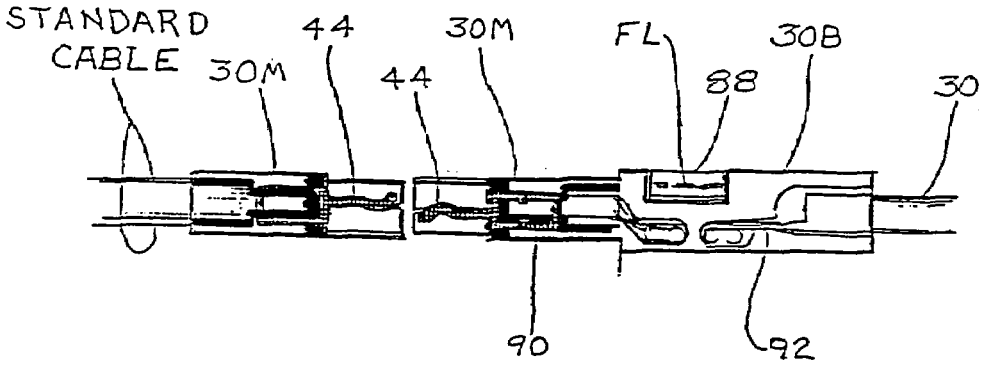
FIG. 10 is a vertical sectional of the cable assemblies in FIG. 3 taken along lines 10-10 of FIG. 9.

In FIG. 10, a longitudinal sectional view along line 10-10 of FIG. 9 shows that the end connectors 30M, as used in all embodiments of this invention, are polarized but genderless, i.e., neither male or female. These connectors will mate only with like polarity end connectors since the two identical spring contacts 44 overlap and will not enter unlike ports to engage + to − and provide reliable low loss connections when engaged. The visible fuse 88 is also seen with its visible fusible link FL. The fuses 86 and 88 are all standard U.S. auto accessory fuses, which are available at auto parts and electrical parts stores in a variety of current limits. They are exchanged by sliding the fuse out and the replacement in as indicated by the double-ended arrow in FIG. 9.

Figure 11:
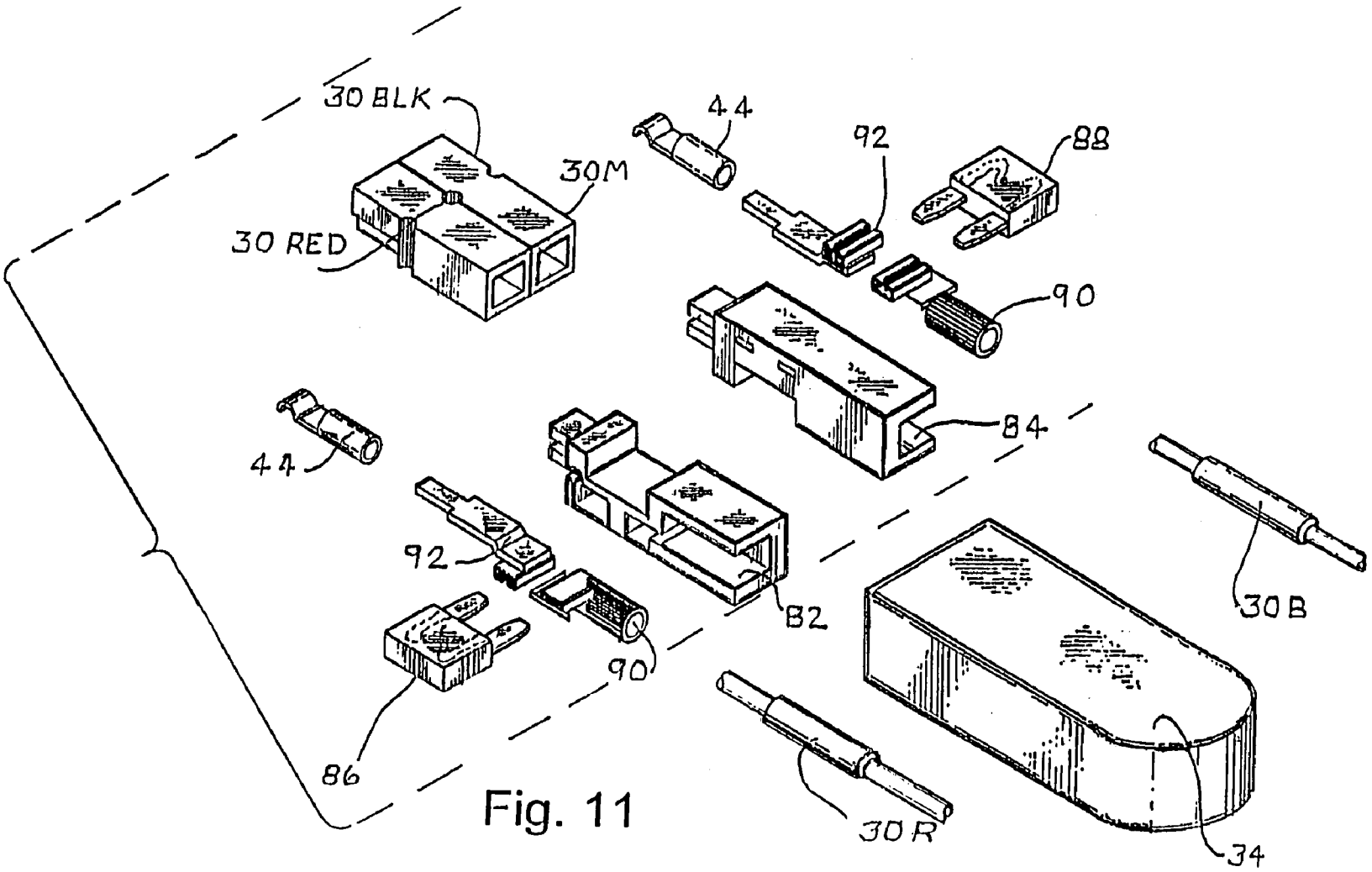
FIG. 11 is an exploded view of a fused end connector assembly of FIG. 7 shown with an end plug cover.
Figure 12:
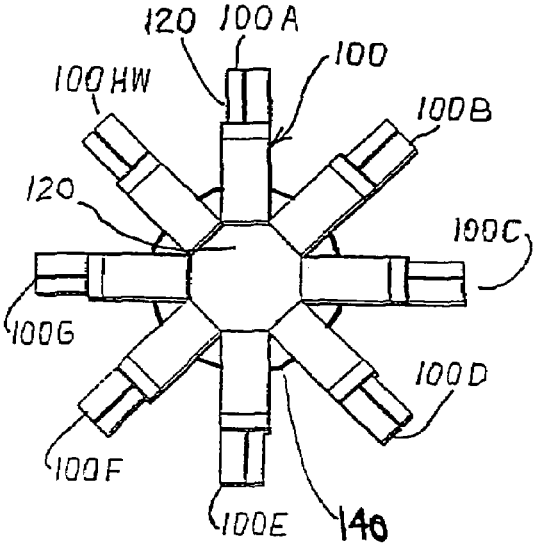
FIG. 12 is a top plan view of an eight-port connector in accordance with this invention with the upper electrode partially exposed.
Figure 13:
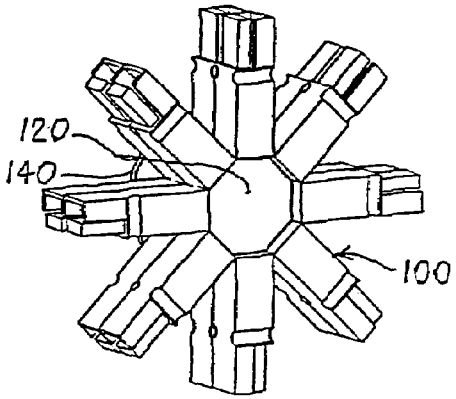
FIG. 13 is a perspective view of the connector of FIG. 12.

FIG. 11 is an exploded view of the fused end connector 80 with insulating end cap 34 used to cover the exposed end of a cable, such as cable 30 and connector 30M shown in FIG. 7.

Eight Port Connector Embodiment

Now referring to FIGS. 12 through 16 where an 8-port connector 100 is illustrated and based upon the 4-port version of FIGS. 2 through 6. In this version, identical reference numerals may be used for identical components as found in earlier figures. One input port 100A can act as the power input port serving seven other power supply ports 100B-100H or to power up to six appliances and feeding power to a sub-cable through any one of the ports, for example, port 100E. The connector ports are each defined by a standard polarized connector, such as the APP connector discussed above, and arranged in an octagonal array of polarized and color coded (red +) and (black −) housings, each of which includes a spring contact 44, appearing only in FIG. 14 and otherwise shielded by the housings 120. At least one end plate 140 is present adhering to the rear or opposite side of eight housings 142 and adding structural strength the octagon assembly 100.

Figure 15:
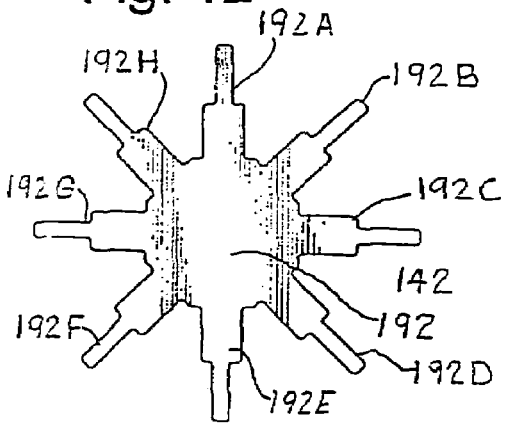
FIG. 15 is a top plan view of connecting the common interconnecting plate or electrode of FIG. 14.
Figure 14:
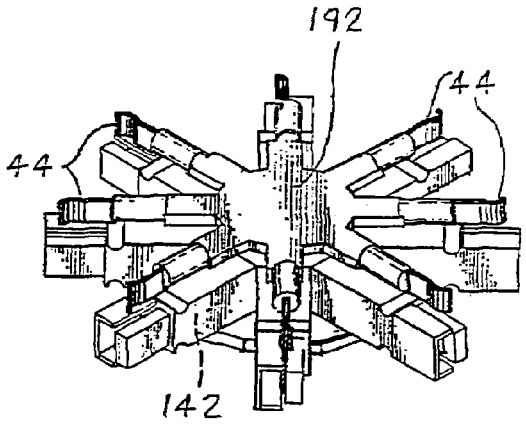
FIG. 14 is a perspective view of the connector of FIGS. 12 and 13 with the upper electrode and spring contacts shown fully exposed without housings.
Figure 16:
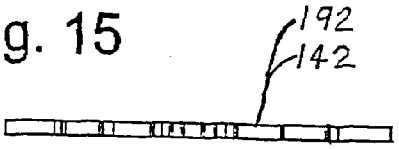
FIG. 16 is a side view of the electrode of FIG. 15.

In FIGS. 14, 15, and 16, the upper (+) octagonal-shaped interconnector or distribution plate 192 is visible with its eight equally spaced arms 192A-H and in FIG. 14 the end contact springs 44 are shown in their operative position on the ends of their respective arms 192A-H. The plate 192 may be fabricated of the same material and thickness as plate 42 utilizing material, such as 48-oz/sq ft copper.

The use of identical standard parts wherever possible, insures the flexibility of the connectors to provide the required power distribution system and error free installation. Low distribution losses are maintained throughout the system particularly by the use of single distribution plates for connection to all parts of the same polarity such as plates 142 and 192, one for each polarity at each connector, as is best shown in FIGS. 15 and 16.

In-Line Connectors

Another form of multi-port connector is illustrated in FIGS. 17 through 21. It is the in-line connector 28 of FIG. 1. As may be seen in more detail in FIG. 17, an array of identical dual housings 22 (red +) and 42 (black −) are mounted in an insulating base 150, with one connector acting as the power input ports IP (red +) and IP (black −), and six pairs of output DC power distribution ports 22 for distribution of power to various equipment as illustrated by inline connectors LP of FIG. 1. Another pair of output ports OP is available at the opposite end from the power input ports IP that may be used by other equipment or connected to another distribution cable.

Figure 17:
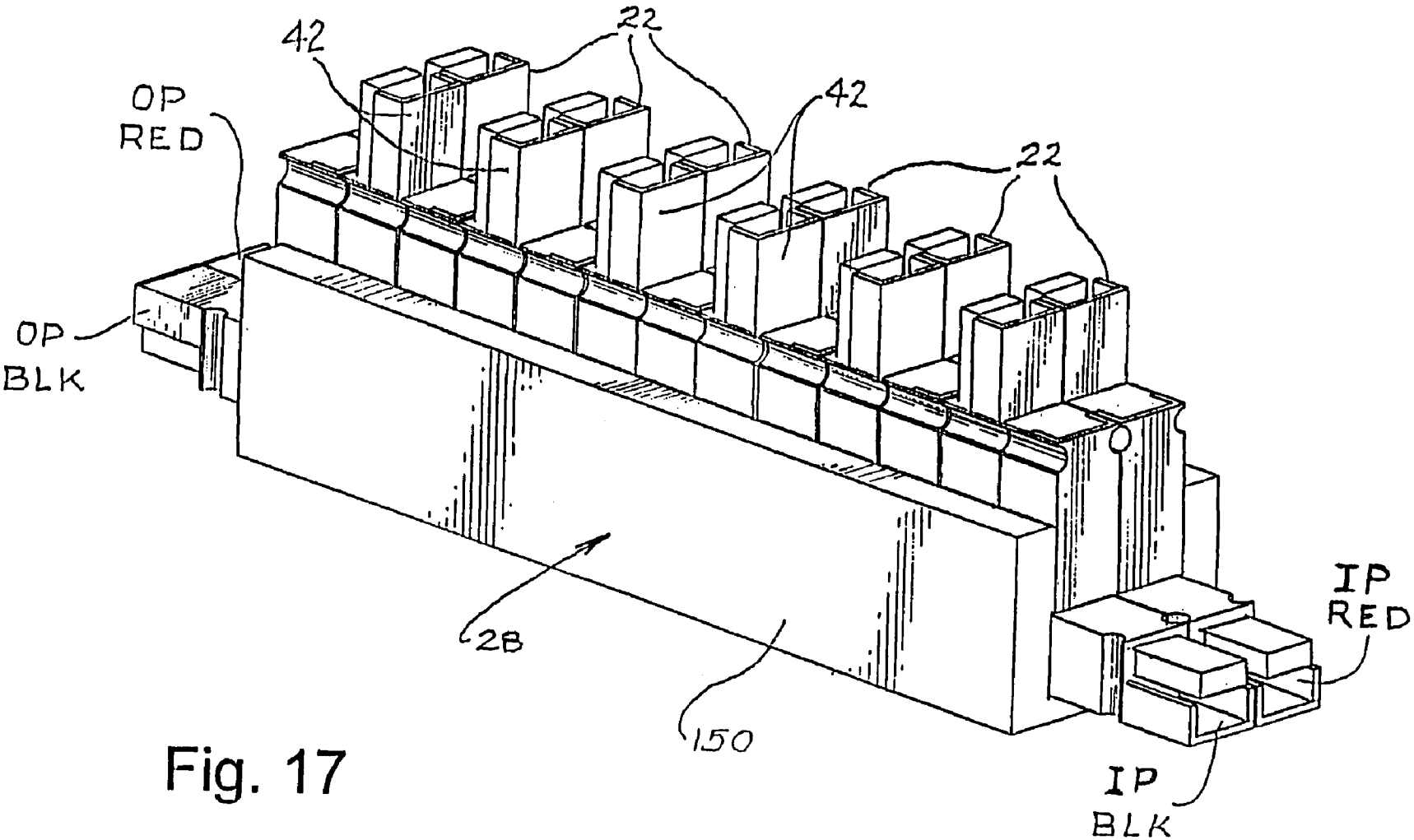
FIG. 17 is a perspective view of a six-output port in-line connector in accordance with this invention.
Figure 18:
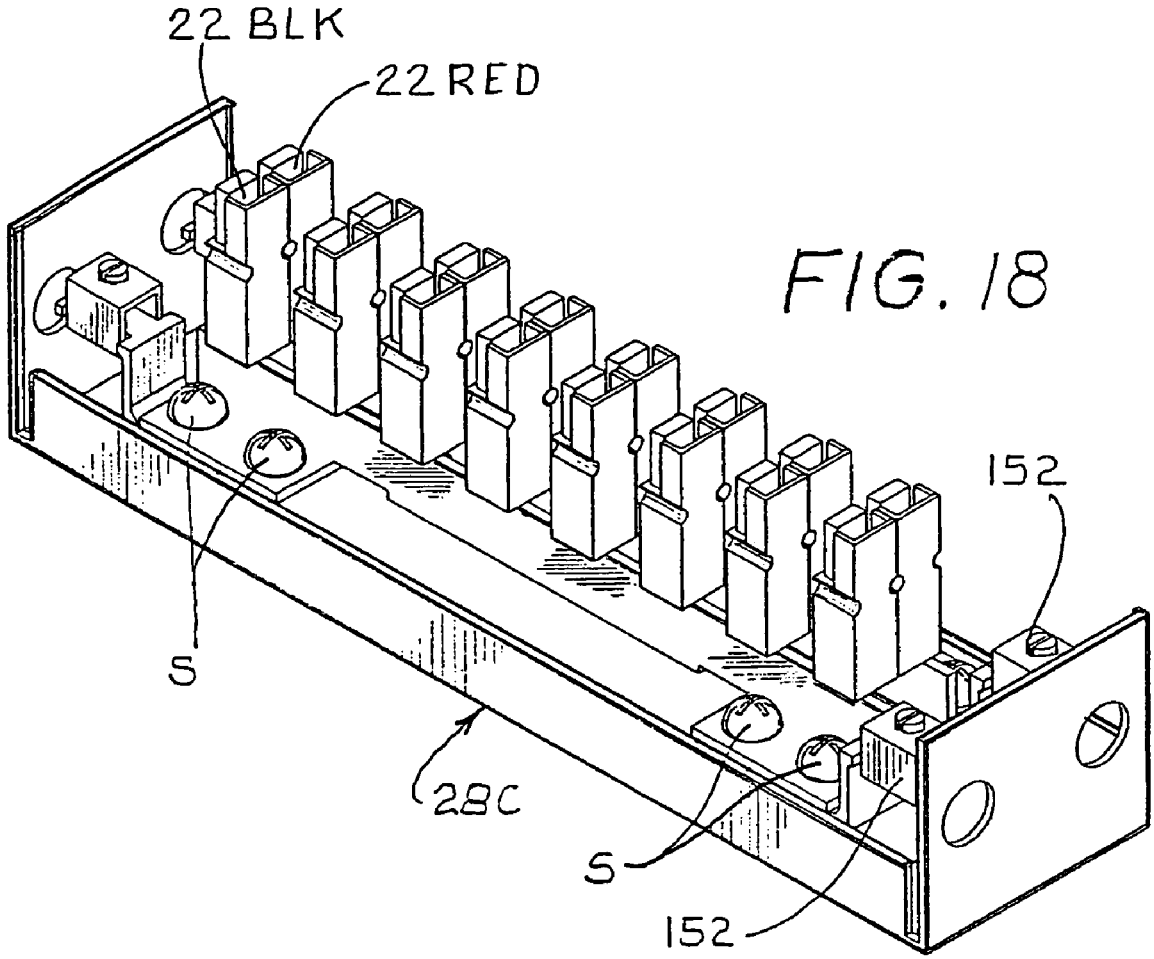
FIG. 18 is a perspective view of an eight output port in-line connector similar in features to the six-output port in-line connector FIG. 17 with the cover removed but employing a cable clamping input and output connections with higher current capacity than other conventional connectors.

The interior of an eight output terminal in-line connector 28C (cable connect) may be seen in FIGS. 18-21, which is similar to the connector 28 of FIG. 17 except that screw/clamp connectors 152 are used instead of the standard connectors 22 and 42 of each of the previous embodiments. This in-line connector 28C, in addition to providing two additional output power distribution as compared with FIG. 17 ports, allows the in-line connector to be used with any insulation stripped cable end and is not limited to the standard connector as used in each embodiment above.

Figure 19:
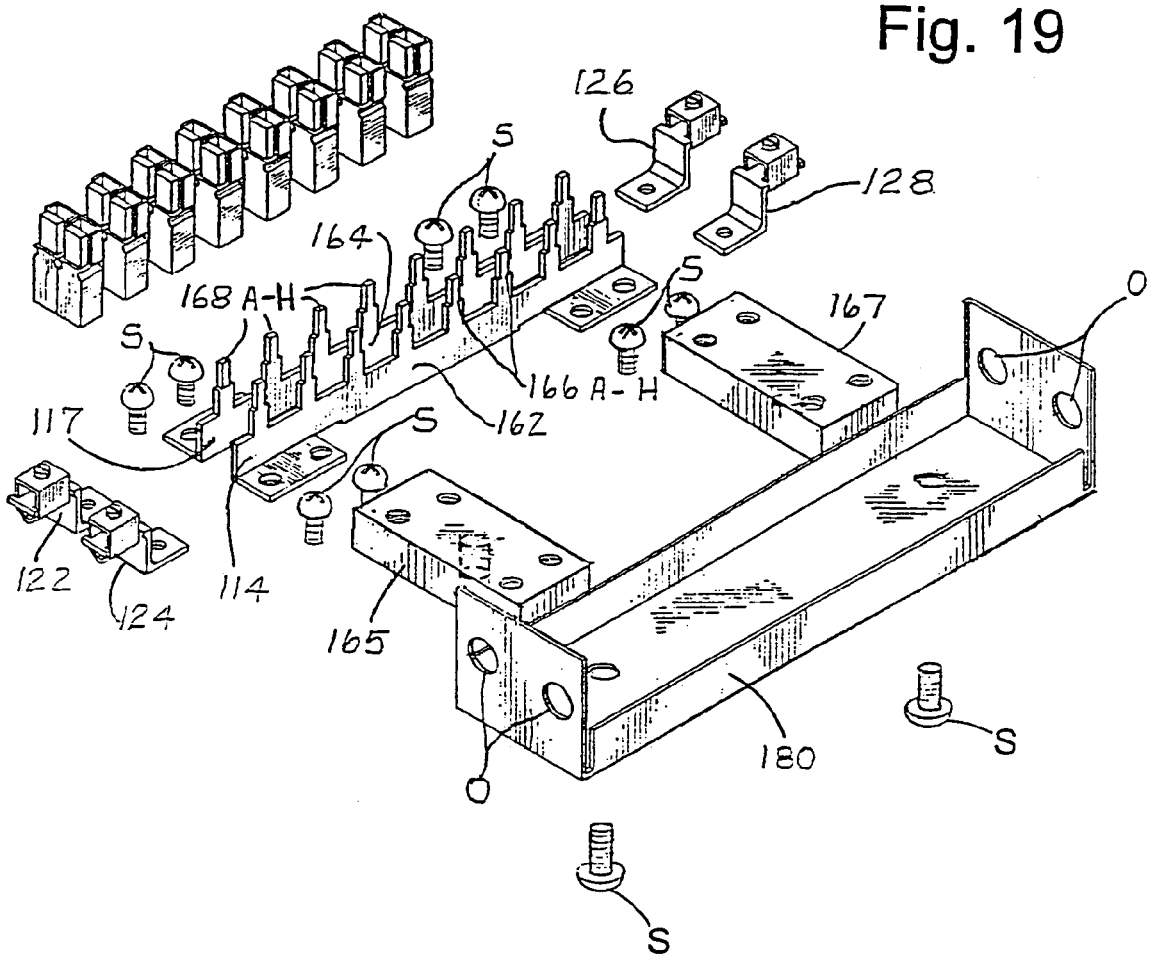
FIG. 19 is an exploded view of the eight output port in-line connector of FIG. 18 showing the electrode components and their support structure.
Figure 20:
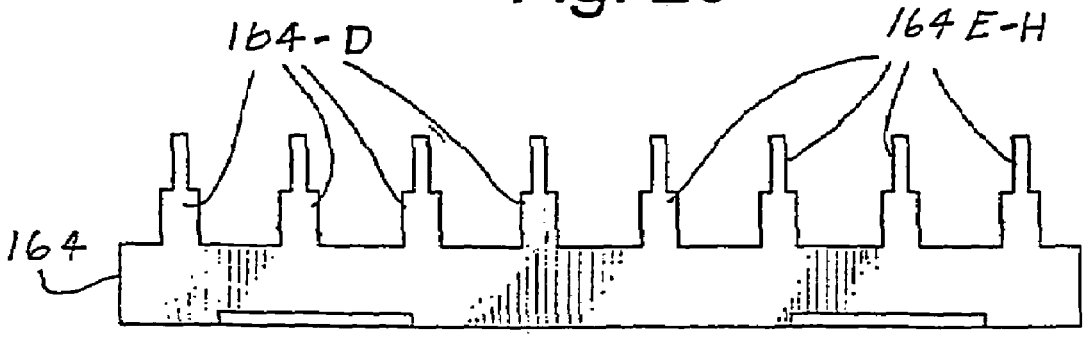
FIG. 20 is a side elevational view of an electrode of the in-line connector of FIGS. 18 and 19.
Figure 21:
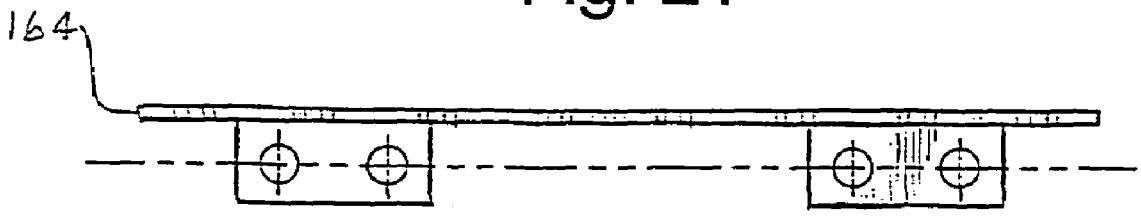
FIG. 21 is a top plan view of the electrode of FIG. 18.

The connectors 22 and 42 each have their housings red or black covering a respective spring clip 44 (unshown) as in previous embodiments that engages upward extending arms of their respective power distribution plates 162 and 164 as shown in FIGS. 19, 20 and 21 with their upstanding arms identified as arms 166A-H and 168A-H. The side tabs of the power distribution plates 162 and 164 are each secured by screws S to insulating support blocks 165 and 167 of FIG. 19 that are secured as by screw attachment inside chassis 180. The chassis 180 includes the end cable entrance openings 0 normally including insulating grommets for the cables to reach the cable clamps 122 and 124 at one end and 126 and 128 at the opposite end. The cable end clamps are all secured to the assembly and particularly to the respective power distribution plates 162 and 164 by the same screws, which mount the power distribution plates, 162 and 164.

Universal Adapter Connectors

Another form of the multi-port connector is illustrated in FIGS. 22 through 25. It is a four-way version similar to the embodiment of FIGS. 2-6 to provide a method to connect a polarized power distribution system using any of a number of different connector families. Various equipment manufacturers install different connector families on equipment they build. End users are thereafter forced to replace connectors supplied with the equipment with a more standard connector compatible with other equipment used by the end user or by other end users. In accordance with this invention, use of a universal adapter as displayed in FIGS. 22 through 25, provides a method to connect low power connectors, between many different families. This concept can also apply to control signals such as antenna rotators or other interface control signals.

Figure 22:
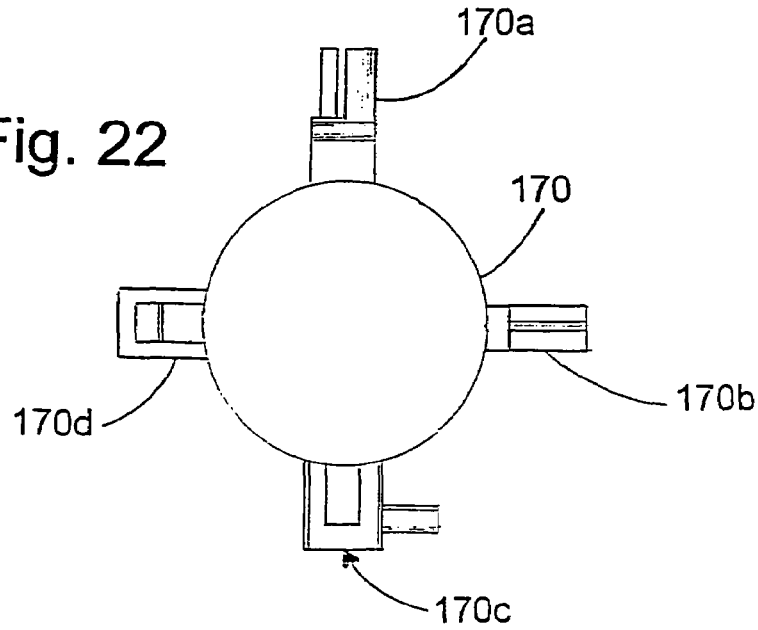
FIG. 22 is a top plan view of a four-port connector in accordance with this invention including four different families of connectors of similar size.
Figure 24:
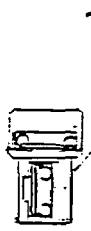
FIG. 24 is an end elevation view of a "T" type connector supplied on many mobile radios and usable in this invention.

As may be seen in more detail in FIG. 22, a four-port connector 20 includes a standardized polarized connector, such as the APP connector capable of 30 amperes such as 170A, a two-pin version of Molex series 1545 connector 170B capable of carrying 8 amperes of current, a European style terminal block such as 170C capable of 30 amperes capacity and accepting stripped wire from 10 to 22 gage which can be field stripped with a conventional wire stripper and terminated using a small screw driver to rotate a screw that clamps the stripped end of the wire, and a "T" connector such as 170D capable of 12 amperes capacity, which has been installed by the manufacturer for power input on many amateur mobile radios.

Figure 23:
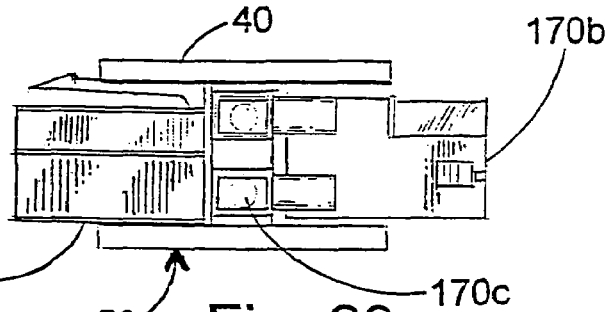
FIG. 23 is a side view of a four port connector of FIG. 22 displaying on the left side a side view of a "T" connector, in the middle, an end view of a European style terminal block, and on the right side, a side view of a "Molex" type two pin series 1545 connector.
Figure 25:
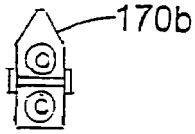
FIG. 25 is an end view of a Molex 2-pin series 1545 connector adaptable to use in this invention.

FIG. 23 is a side view of the multi-port connector 170 that from the left displays a side view of the "T" connector 170D.

In the middle is an end view of the European style terminal block 170C, and on the right side is the 2-pin version of the Molex series 1545 connector, with covers 40 on the top and 50 on the bottom that serve as closure for both the cruciform shaped positive + and negative – interconnectors that are also invisible but similar to FIGS. 2 through 6.

SUMMARY

An entire DC power distribution system using standard connectors integrated into a flexible, polarized array is disclosed. Fusing may be introduced into the system at any place in the system and overloads may be easily detected and remedied. All components are interchangeable and polarized. The system and each of the components are conveniently stored, transported, deployed, and in operation in a matter of minutes. Connections can be reconfigured or disassembled and transported in a matter of minutes. Error-free connections are assured.

The preferred basic connector type is the APP connector, however, employing the universal connector 170 of FIGS. 22 through 25 and as many as four different connector families may be serviced by this invention.

The above-described embodiments of the present invention are merely descriptive of its principles and are not to be considered limiting. The scope of the present invention instead shall be determined from the scope of the following claims including their equivalents.

I claim:

1. A system for distributing direct current power from a power source to a series of direct current power requiring appliances comprising:

two conductor plus + and minus – insulated cabling means including a first end connectable to a source of direct current power and a second end for supplying power to the series of direct current power requiring appliances;

polarized plus + and minus – genderless, end connectors, at least one of said connectors including at least one fuse in series with one of said conductors on at least said second end of said two conductor insulated cabling means;

at least one multi-port polarized genderless mating connector connectable to said polarized + and minus – end connector of said two conductor cabling means;

said multi-port polarized mating connector including a single common interconnecting conductor means within said multi-port polarized mating connector for each said polarized plus + and minus – end connector;

whereby a plurality of direct current utilizing appliances may be simultaneously connected properly polarized and fused to a common power source via said cabling means and said multi-port polarized mating connector; wherein single genderless contacts mechanically secure and electrically connected to respective arms of said single common interconnecting means and are located in each port.

2. A system in accordance with claim 1 wherein one of said connectors includes a second fuse is connected in series with the second of said two conductors.

3. A system in accordance with claim 1 wherein the fusible element of said fuse is visible from the exterior of said connector.

4. A system in accordance with claim 1 wherein the number of ports in said multi-port polarized mating connector is four and wherein said common interconnecting conductor means comprise a pair of generally cruciform shaped low resistance rigid plates, one for each polarization with one arm thereof directed toward a respective port thereby providing a common electrical connection to each port.

5. A system in accordance with claim 4 wherein at least one of said multi-port polarized mating connector includes at least two polarized connector ports from a different connector family whereby said system is capable of delivering direct current power to appliances having a different connector type.

6. A system in accordance with claim 4 wherein said genderless spring contacts are leaf springs secured one in each respective ports and extend into their respective port at one side thereof for engagement with a similar mating spring contact in a mating connector.

7. A system in accordance with claim 1 wherein said multi-port polarized mating connector having a generally flat portion with polarized housing portions of said connectors defining each pair of ports, one for a plus + connection and one for a minus – connection, said ports extending generally laterally from said generally flat portion.

8. A system in accordance with claim 7 wherein said housings are color-coded differently for the plus + connection and the minus – connection.

9. A system in accordance with claim 7 wherein said leaf springs include a displaced end portion, which constitutes an engagement region for mating with a similar leaf spring on a mating connector.

10. A connector for use in power distribution systems comprising:

a housing including a plurality of pairs of two terminal ports;

each of said ports being polarized for limiting the entrance of mating electrical terminals of the same polarization;

a single first low loss rigid electrical interconnecting member within said housing joining all said polarized ports of the same polarity;

a single second low loss rigid electrical interconnecting member joining all said polarized ports of a different polarity from said first polarization;

said first and second electrical interconnecting members being mechanically secured and electrically connected to portions of said respective low loss interconnecting member within said housing in spaced and insulated relationship with respect to each other while providing electrical connections at each port;

wherein each of said terminal ports includes a genderless electrical terminal contact in said port;

whereby contact and electrical connection can be made in each polarization by a similar contact in a mating port; wherein said electrical interconnecting members having extending arms which arms terminate in electrical connections for genderless spring contacts in each pair of polarized genderless ports formed by said housing.

11. An electrical connector in accordance with claim 10 when the housing defines any of said sets of ports of different polarization for a total of at least eight ports providing at least four two conductor ports may constitute the power input to the connector and the remaining sets of pairs of ports may constitute output ports.

12. An electrical connector in accordance with claim 10 wherein said electrical interconnecting members are low loss rigid conductive plates of cruciform shape with outward extending arms which arms terminate in electrical connections for respective ports of said housing.

13. An electrical connector in accordance with claim 10 wherein said housing is color-coded differently for each port of said pairs of ports.

14. An electrical connector in accordance with claim 10 wherein an insulating member is positioned in said housing between said electrical interconnecting members.

15. An electrical connector in accordance with claim 10 wherein said housing defines a total of eight pairs of polarized genderless ports of which any pair may constitute the power input ports to the connector and the remaining seven pairs of ports may constitute power output ports.

16. An electrical connector in accordance with claim 15 wherein an insulating member is positioned in said housing between said electrical interconnecting members.

17. An electrical connector in accordance with claim 15 wherein said ports enclose genderless electrical spring contacts electrically and mechanically secured to its respective electrical interconnecting member.

18. An in-line connector for the distribution of power of two different polarizations comprising:

an elongated housing including at least one pair of power input terminal openings at one end thereof and a plurality of pairs of power output ports on at least one side thereof;

a pair of elongated rigid conductive plates; each including a plurality of laterally extending arms;

a plurality of laterally extending genderless spring contacts fixed on said laterally extending arms of said plates;

said elongated conductive plates being insulatingly secured within said housing and spaced from each other;

said elongated conducting plates having input terminals adjacent to respective power input terminals of said housing;

said laterally extending spring contacts from each elongated conductive plates constituting a pair of genderless output terminals connections for said connector; and polarized enclosures defining output ports for each pair of genderless output terminals;

whereby power inputted at said input ports may be distributed through any of the plurality of polarized genderless output terminals.

19. An in-line electrical connector in accordance with claim 18 where in the number of pairs of output ports is at least six.

20. An in-line connector in accordance with claim 18 wherein the power input terminals include genderless spring terminals in said polarized enclosures for said power input terminals of the same polarization as the laterally extending output ports;

whereby any of said ports may act as input or output ports.

21. An in-line connector in accordance with claim 18 wherein said genderless terminals constitute leaf-spring contacts.

22. An in-line connector in accordance with claim 18 wherein said elongated plates include lateral extensions and wherein said genderless spring contacts are secured to said extensions and said genderless spring contacts are deflectable upon contact with similar genderless spring contacts to provide spring loaded electrical contact between the in-line connector and a connector having similar polarization.

23. An in-line connector in accordance with claim 18 wherein said elongated conductive plates are connectable to a source of power via cable clamps in the region of said power input terminal openings.

24. An electrical cable connector assembly comprising:

an insulated cable having at least two conductors and a first end and a second end;

a first polarized connector genderless spring contacts connected to at least two of said conductors at said first end;

a second polarized connector genderless spring contacts connected to at least two of said conductors at said second end having the same polarization as said first polarized connector; and a first fuse holder including a fuse visible opening therein connected in series between a first of said conductors and said first polarized connector; and a second fuse holder including a fuse visible opening therein connected in series between the second conductor and said second polarized connector.

25. An electrical cable in accordance with claim 24 wherein said fuse holder is mechanically secured and electrically connected to one of said polarized connectors.

26. An electrical cable in accordance with claim 24 wherein said polarized connectors are genderless whereby connectors at both ends may be connected together or to any other similar polarized connector while maintaining polarization.

27. An electrical cable in accordance with claim 24 wherein said polarized end connectors each have an insulating body having two ports, one for each of two conductors of said cable and the two ports are differently color coded.

28. An electrical cable in accordance with claim 24 wherein said fuse holder positions a fuse in electrical series with one conductor and in a position whereby the fuse's condition is observable while in the fuse holder by merely viewing the end connector.

29. An inline connector for low voltage D.C. power distribution systems comprising:

an elongated base;

a pair of elongated rigid conductive plates;

means for insulatingly mounting said elongated rigid conductive plates to said elongated base in spaced parallel relationship;

each of said elongated conductive plates having a plurality of upwardly extending arms for providing a plurality of pairs of output terminals;

said elongated rigid conductive plates each containing a longitudinally extending terminal on at least one end thereof together to provide a pair of input terminals for said inline connector;

polarized housing means for said inline connector enclosing said elongated conductive plates and wherein said housing means defines discrete polarized output ports for each of said output terminals; and genderless spring contact means within said polarized housing secured to each of upwardly extending arms of said plates for providing spring contact for respective elongated conductive plates.

30. An inline connector in accordance with claim 29 wherein said spring means constitute genderless electrical contacts.

31. An inline connector in accordance with claim 29 wherein each end of said connector includes genderless polarized electrical connectors, one constituting an input connector and the connector at the opposite end constitutes a polarized output connector.

32. An inline connector in accordance with claim 29 wherein at least one of said end terminals is a connector of the same type as the output terminals.

33. An inline connector in accordance with claim 29 wherein at least one of said end terminal connectors is a cable clamp.

34. An inline connector in accordance with claim 29 wherein said housing means includes individual polarized ports for each output terminal wherein the ports for each lateral terminal of one elongated conductive plate is of different polarization from the ports of each lateral terminal of the second of said elongated conducting plates.

* * * * *